US006394299B1

(12) United States Patent
Hupp

(10) Patent No.: US 6,394,299 B1
(45) Date of Patent: May 28, 2002

(54) SLIDER FOR OPENING OR CLOSING A RECLOSABLE FASTENER DISPOSED IN A TWO DIMENSIONAL PLANE

(75) Inventor: Matthew Todd Hupp, Sharonville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/481,456

(22) Filed: Jan. 11, 2000

(51) Int. Cl.[7] ..... B65D 43/16

(52) U.S. Cl. ..... 220/315; 220/4.21; 383/64; 24/415

(58) Field of Search ..... 220/315, 4.21, 220/4.22, 4.23, 4.24, 780, 783; 383/63, 64; 24/399, 400, 415

(56) References Cited

U.S. PATENT DOCUMENTS

| | | | | |
|---|---|---|---|---|
| 2,629,911 A | | 3/1953 | Macy | |
| 2,665,467 A | | 1/1954 | Bosomworth et al. | |
| 2,736,079 A | | 2/1956 | Staller et al. | |
| 2,756,172 A | | 7/1956 | Kidd | |
| 2,972,792 A | | 2/1961 | Johnson | |
| 3,103,049 A | * | 9/1963 | Hawley | |
| 3,122,807 A | * | 3/1964 | Ausnit | 383/64 |
| 3,660,875 A | | 5/1972 | Gutman | |
| 3,784,055 A | | 1/1974 | Anderson | |
| 3,790,992 A | * | 2/1974 | Herz | 383/64 |
| 3,967,756 A | | 7/1976 | Barish | |
| 4,896,775 A | * | 1/1990 | Boeckmann et al. | 383/64 |
| 5,062,186 A | | 11/1991 | Rampolla et al. | |
| 5,524,990 A | * | 6/1996 | Buck | |
| 5,636,783 A | | 6/1997 | Preston | |
| 5,662,758 A | | 9/1997 | Hamilton et al. | |
| 5,826,717 A | * | 10/1998 | Eskandry | |
| 5,871,067 A | | 2/1999 | Hamilton et al. | |
| 5,965,235 A | | 10/1999 | McGuire et al. | |
| 6,092,687 A | * | 7/2000 | Hupp et al. | 220/315 |
| 6,161,959 A | * | 12/2000 | Abraham | |
| 6,194,062 B1 | | 2/2001 | Hamilton et al. | |

FOREIGN PATENT DOCUMENTS

| | | |
|---|---|---|
| BE | 505325 | 9/1951 |
| GB | 387480 | 2/1933 |
| JP | 10-305866 | * 11/1998 |
| WO | WO 00/64772 A1 | 11/2000 |

OTHER PUBLICATIONS

U.S. Ser. No. 08/745,339, filed Nov. 8, 1996, McGuire et al.
U.S. Ser. No. 08/745,340, filed Nov. 8, 1996, Hamilton et al.

* cited by examiner

*Primary Examiner*—Nathan J. Newhouse
(74) *Attorney, Agent, or Firm*—David K. Mattheis; David M. Weirich; Jay A. Krebs

(57) ABSTRACT

A slider opens or closes an elongate, rigid reclosable fastener sealing a lid to the flange of a container where the fastener lies in a plane defining mutually orthogonal directions. The slider is slidably movable and attachable to a track disposed along the fastener defining a travel path having vector components in each of the orthogonal directions. The slider biases interlocking elements of the reclosable fastener operatively associated therewith into engagement with one another as the slider moves in a first direction and separates interlocking elements as the slider moves in a second direction opposite the first.

22 Claims, 9 Drawing Sheets

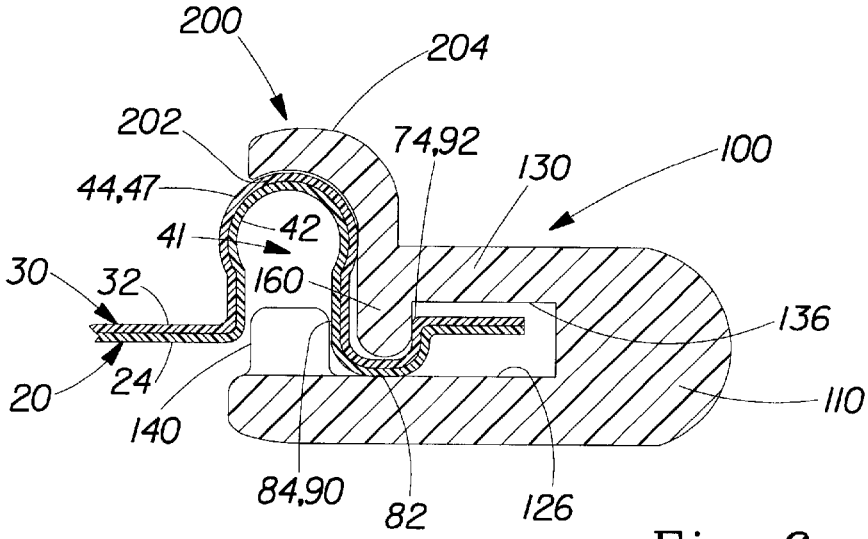
Fig. 6a
Fig. 6b
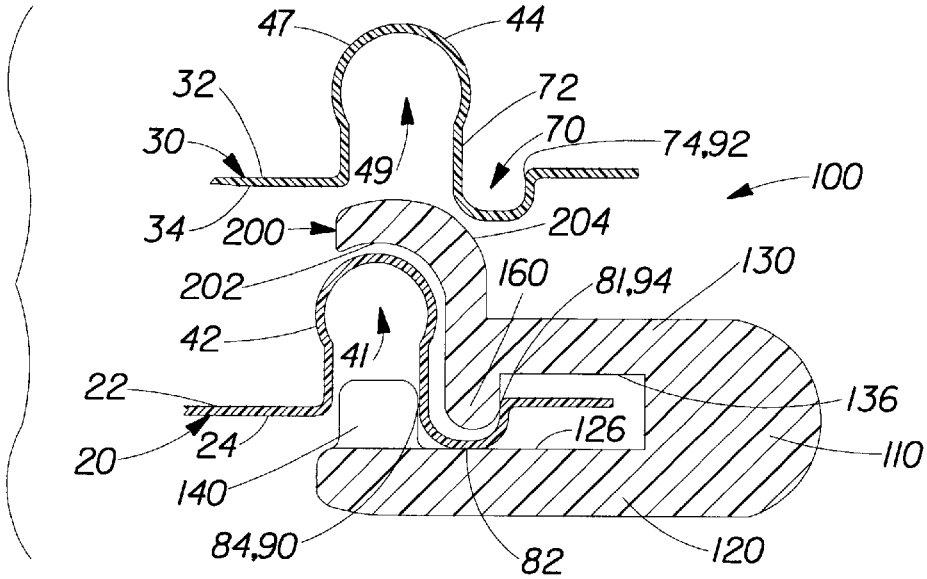

SLIDER FOR OPENING OR CLOSING A RECLOSABLE FASTENER DISPOSED IN A TWO DIMENSIONAL PLANE

FIELD OF THE INVENTION

The invention relates to sliders for opening or closing reclosable fasteners, particularly rigid, elongate reclosable fasteners lying in a plane defining mutually orthogonal X and Y directions.

BACKGROUND

Flexible storage bags for use in the containment and protection of various items, as well as the preservation of perishable materials such as food items, are well known in the art. Such bags typically comprise an elongate reclosable fastener such as an interlocking rib-type seal integrally formed with the bag, to seal contents disposed in the bag. Sliding closure mechanisms, which utilize a sliding plastic sleeve to bias interlocking ribs into and out of engagement, have become popular due to their comparative ease of operation and visual and tactile confirmation that the seal formed by the reclosable fastener has been successfully completed.

Rigid and semi-rigid containers are also well known in the art. Such containers have realized a fair degree of commercial success in providing a means for storing a wide variety of contents. These containers typically incorporate lids which are usually sealed to the container by a reclosable fastener comprising interlocking protruded and recessed elements such as bulbs and grooves. Additionally, U.S. Pat. No. 3,784,055 issued Jan. 8, 1974 to Anderson, and U.S. Pat. No. 3,967,756 issued Jul. 6, 1976 to Barish, both of which are incorporated herein by reference, disclose containers utilizing plug seals.

While such mechanical closures can be effective in preserving container contents, some consumers experience difficulty in fully completing the closure operation and confirming for themselves that a satisfactory closure has been achieved. This is particularly so when the physical change in position of the lid between interlocked and non-interlocked positions is comparatively small.

Traditional sliders used with reclosable fasteners on flexible storage bags assures the user that the fastener is opened or closed during use, however, such sliders typically embody sidewalls limiting their operation to unidirectional fasteners. An example of a traditional type slider is illustrated in U.S. Pat. No. 3,660,875 issued May 9, 1972 to Gutman, and incorporated herein by reference. Since rigid and semi-rigid containers typically incorporate lids sealed by fasteners extending in directions having vector components extending in mutually orthogonal directions, the traditional sliders are unsuitable for opening or closing such fasteners.

Accordingly, it is desirable to provide a slider for opening or closing a reclosable fastener for sealing a lid to a storage container wherein the reclosable fastener lies in a two dimensional plane defining mutually orthogonal directions. Particularly, it is desirable to provide a slider that is slidably attachable to the reclosable fastener and capable of effectively opening or closing the fastener while pivoting around corners joining mutually orthogonal sections or curvilinear segments of the fastener. More particularly, it is desirable to provide a slider having the aforementioned attributes that can effectively open and close the reclosable fastener requiring minimal maneuvering by the consumer other than moving the slider along the fastener.

SUMMARY OF THE INVENTION

A slider opens or closes an elongate, rigid reclosable fastener sealing a lid to the flange of a container where the fastener lies in a plane defining mutually orthogonal X and Y directions. The slider is slidably movable and attachable to a track disposed along the fastener defining a travel path having vector components in each of the X and Y directions. The slider biases interlocking elements of the reclosable fastener operatively associated therewith into engagement with one another as the slider is moved in a first direction along the travel path and separates interlocking elements as the slider is moved in a second direction along the travel path, opposite the first direction. The slider comprises a base having a first surface with first and second elongate members extending therefrom in a spaced apart, side-by side arrangement. The first and second elongate members, each have proximal ends depending from the first surface of the base, distal ends extended away from the base and opposing internal surfaces. The first elongate member includes a pivot depending from the internal surface at the distal end projecting towards the second elongate member. The second elongate member includes a tracking member depending from the internal surface at the distal end projecting towards the first elongate member. The first and second elongate members straddle the edge of the lid and flange joined by the reclosable fastener as the pivot and tracking member interface with the track.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 6*a* is a cross sectional view of the closing end of the slider depicted in FIGS. 5*a*–5*c* shown slidably attached to a reclosable fastener in the closing configuration.

FIG. 6*b* is a cross sectional view of the opening end of the slider depicted in FIGS. 5*a*–5*c* shown slidably attached to a reclosable fastener in the opening configuration.

DESCRIPTION

As used herein, the following terms have the following meanings:

X, Y, and Z are coordinates defining perpendicular directions intersecting one another at right angles at an origin.

Rigid means deficient or devoid of flexibility; appearing stiff and unyielding, remaining unaltered when typical in-use forces are applied.

A reclosable fastener is a fastener that is selectively openable, sealable, reopenable and resealable.

The present invention pertains to a slider suitable for opening or closing an elongate reclosable fastener. Although the slider of the present invention is applicable for opening all types of reclosable fasteners used for sealing flexible storage bags, tubs, or other storage containers, it is particularly suitable for opening or closing rigid, elongate reclosable fasteners lying in an X-Y plane requiring the slider to travel along a path having vector components in the X and Y directions. More particularly, the slider according to the present invention is suitable for opening or closing a rigid elongate reclosable fastener lying in an X-Y plane and sealable in a Z direction orthogonal thereto, whereby the slider imparts forces to the fastener in the Z direction to open or close the same as the slider moves along the travel path. An example of such a reclosable fastener is one sealing a lid 30 to the flange 20 of a storage container 10 as illustrated in FIG. 1.

The container 10 according to the present invention may be relatively small, such that the container 10 may be stored in one's pocket or purse. Such a container 10 may be useful for storing pills, capsules, etc. Alternatively, the container 10 may be relatively large such that the container 10 is sized to fit a flat bed semi-truck. Such a container 10 may be useful for carrying construction materials, etc. One contemplated use for the container 10 is to store perishable items such as food.

Figure 1:
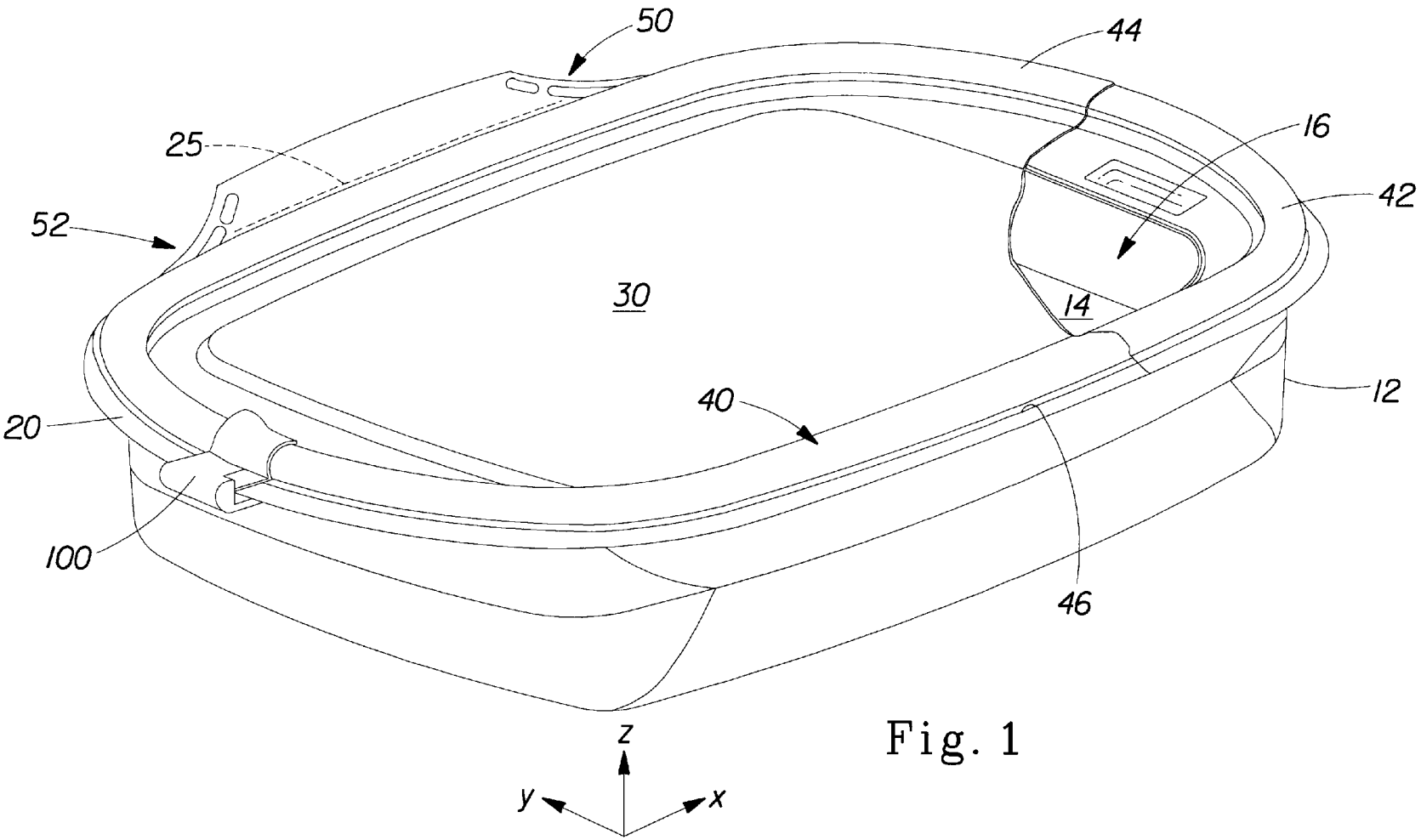
FIG. 1 is perspective view of a storage container incorporating a slider for opening or closing a reclosable fastener attaching the lid to the container.

In the embodiment depicted in FIG. 1, the storage container 10 includes a container body 12 which may be unitarily formed from a piece of sheet material, a planar or domed shaped bottom side 14 defining an X-Y plane, an opening 16 shown opposite the bottom side 14, a flange 20 circumscribing the opening 16, and a lid 30 for covering the opening 16. Both the flange 20 and the lid 30 are illustrated as planar but may be shaped concave or convex relative to the bottom side 14.

Although the container body 12 illustrated has 4 sidewalls, the body may actually comprise three or more sidewalls. In addition, although the opening 16 in the container illustrated in FIG. 1 is disposed opposite the bottom side 14, the invention is applicable openings 16 disposed on any side of the container.

The flange 20 may be either unitarily formed with the container body 12 or provided as a separate material element joined to the container body 12. When provided as a separate, preferably more rigid material element, it is preferred that the container body 12 material be formed into at least a small peripheral flange 20 at its upper edge (defining the opening 16) with pleated comers so as to form a suitable junction point for joining the container body 12 to the flange 20. The lid 30 may be either unitarily formed with the container body 12 or at least hingedly attached to the flange 20 at a hinge line 25. The hinge line 25 may comprise a unitary living hinge or be provided as a line of weakness by scoring, perforations, or the like which may optionally permit the lid 30 to be separated from the container body 12. While a hinged embodiment is shown, embodiments without hinges are contemplated.

The reclosable fastener 40 may circumscribe or partially enclose the container opening 16. The reclosable fastener 40 may comprise any type of reusable mechanical seal known in the art. Suitable seals include friction fit or a compression fit fin seals, adhesive seals, cohesive seals, and selectively activatable adhesives as illustrated by commonly assigned U.S. Pat. No. 5,662,758, issued Oct. 2, 1997 in the names of Hamilton, et al., U.S. Pat. No. 5,871,067, issued Feb. 16, 1999 in the names of Hamilton, et al., application Ser. No. 08/745,339, filed Nov. 8, 1996 in the name of McGuire, et al., and application Ser. No. 08/745,340, filed Nov. 8, 1996 in the name of Hamilton, et al., incorporated herein by reference. By reusable, it is meant that the lid 30 of the container 10 may be reversibly transformed between each of the open and closed positions at least two times and still functionally seal the container 10.

In the embodiment shown in FIG. 1, the reclosable fastener 40 comprises mechanical interlocking elements 42, 44 which includes at least one protruded element 42 interlocking with at least one recessed element 44 to form a seal. The two interlocking elements 42, 44 circumscribe the container opening 16, occupying a marginal portion of the lid 30 and a marginal portion of the flange 20. The interlocking elements 42, 44 are preferably spaced a substantially constant distance inwardly from the peripheral edge of the lid 30 and flange 20 enabling a slider 100 having an adequate inward extent to be drawn along the peripheral edge without leaving gaps or unsealed portions.

Figure 2A:
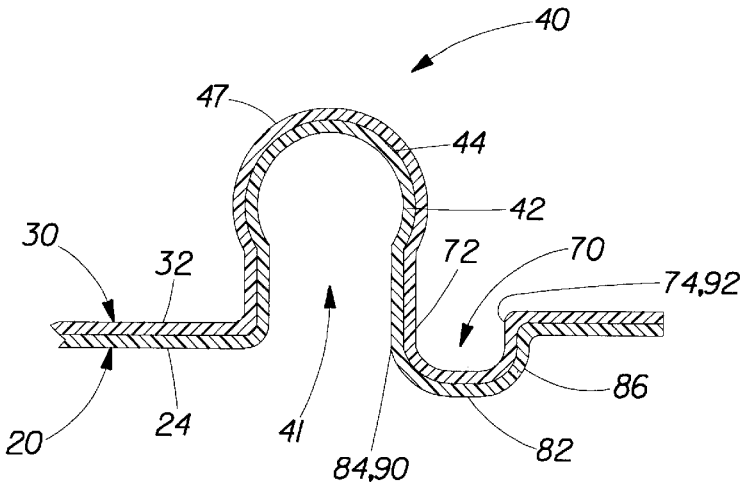
FIG. 2*a* is a cross sectional view of interlocking elements of the elongate reclosable fastener sealing the lid to the flange of the container depicted in FIG. 1.
Figure 2B:
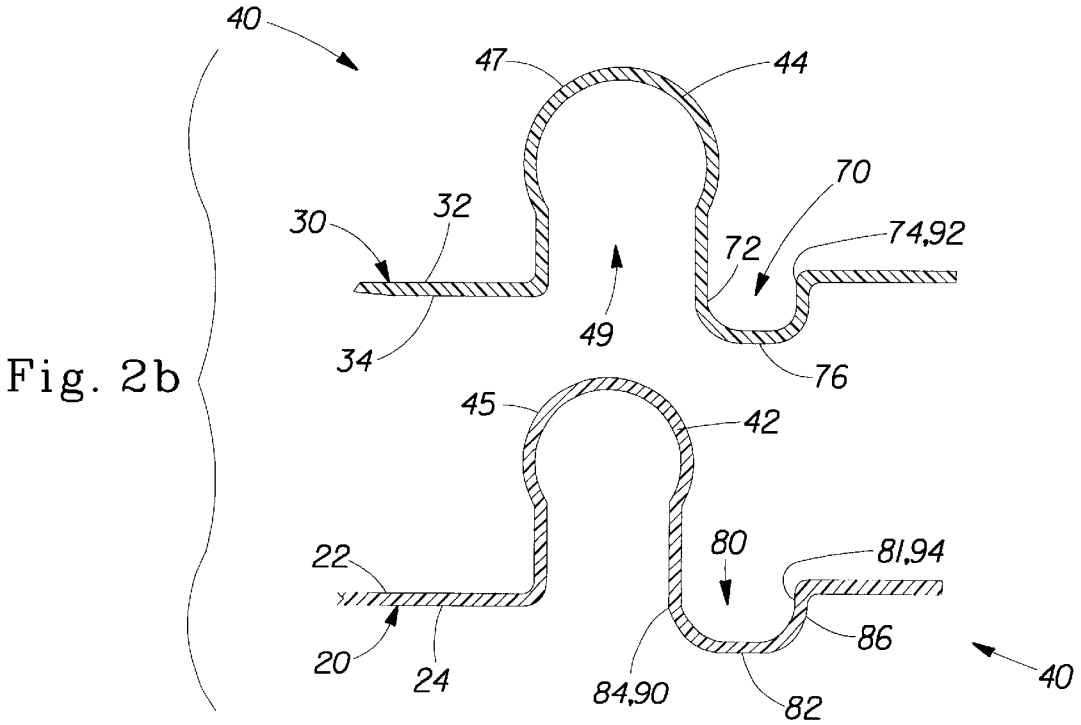
FIG. 2*b* is a cross sectional view of the elongate reclosable fastener depicted in FIG. 2*a* showing the interlocking elements separated apart in an opened configuration.

As illustrated in FIGS. 2*a* and 2*b*, the protruded element 42 may have a bulbous shape and the recessed element 44 may be a groove 49 shaped complementary to the protruded element 42. The interlocking elements 42, 44 are disposed on mating portions of the flange 20 and lid 30. The protruded element 42 may be unitarily formed with the flange 20 extending upwardly from the top side 22 of the flange 20 while the recessed element 44 may be uniformly formed with the lid 30 having a bulbous non-interlocking surface 47 extending upward from the top side 32 of the lid 30 or vice versa. The recessed element 44 is open on the bottom side 34 of the lid 30 so as to receive the protruded element 42 therein while the protruded element 42 is open on the bottom side 24 of the flange 20.

The slider 100 depicted in FIG. 1 has a generally C-shaped configuration with ends of the slider 100 straddling the peripheral edges of the flange 20 and lid 30 in overlying relation enabling portions of the slider 100 to interface with the interlocking elements 42, 44 of the reclosable fastener 40. One portion of the slider 100 which interfaces with interlocking elements 42, 44 has a spacing therebetween which is sufficiently small as to bias the elements into interlocking engagement when the slider 100 is translationally drawn in a first direction over a region of the periphery where the elements are separated. Other portions of the slider 100 urge the interlocked elements 42, 44 apart as the slider 100 moves in a second direction opposite the first direction, applying separating forces.

The reclosable fastener 40 may define a continuous travel path having vector components in the X and Y directions and extending from an opened end 50 to a closed end 52 for directing the motion of the slider 100 along the fastener 40. Alternatively, as illustrated in FIG. 1, a track 46 may be disposed along side of the fastener defining the continuous travel path 48.

The travel path 48 may comprise a combination of rectilinear sectors running in mutually perpendicular directions, with one sector running substantially parallel to the X direction and an adjacent sector running substantially parallel to the Y direction. The sectors are joined via a transition region which may comprise an arc having a radius of curvature and a perimeter having points of tangency with vector components in the X and Y directions. The travel path 48 may also be entirely curvilinear having an oval shape or comprise a series of arcuate sectors forming a path having a wavy pattern such as a sinusoidal shape.

Figure 3:
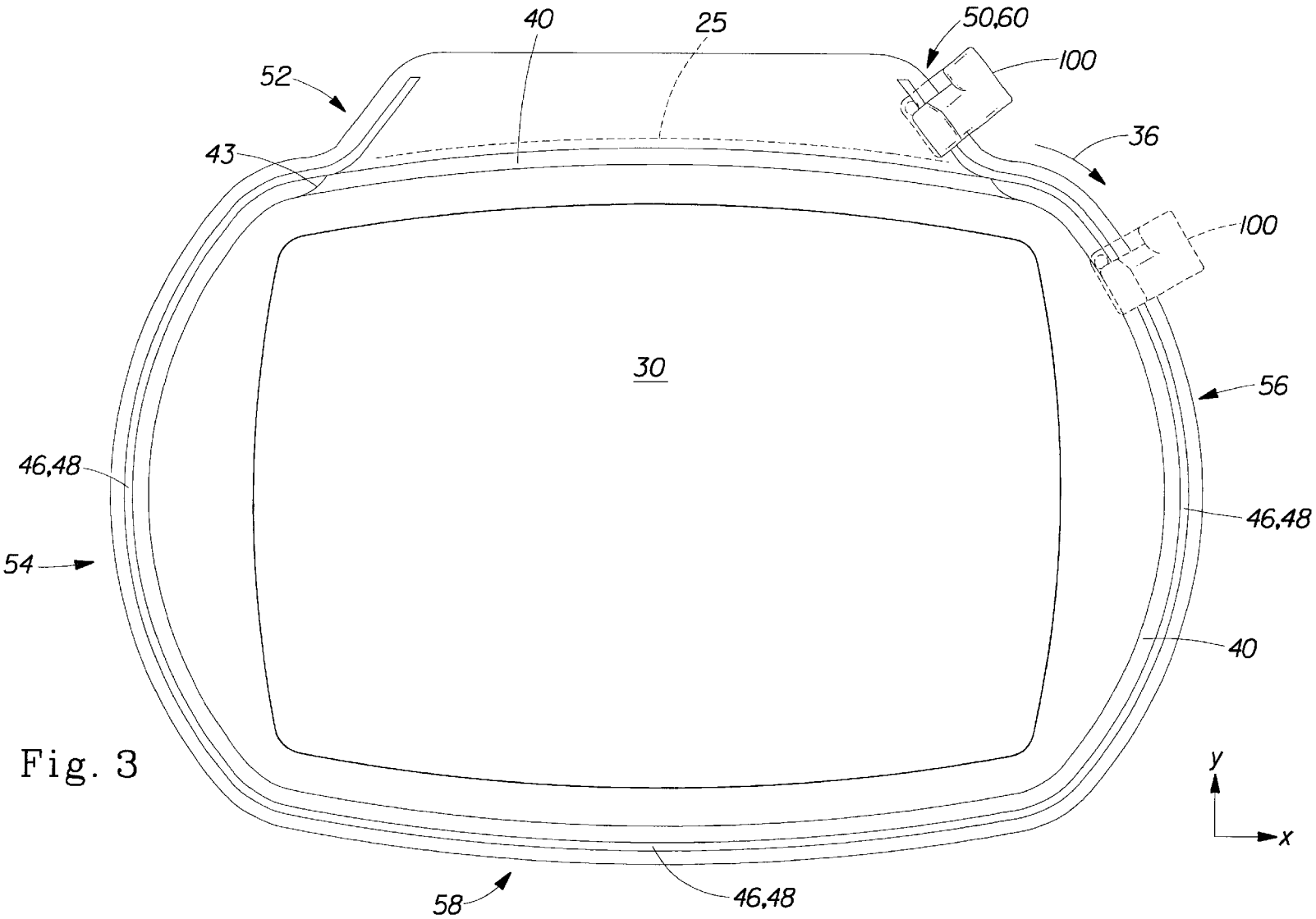
FIG. 3 is a top view of the storage container depicted in FIG. 1 showing the travel path of the slider and a first direction of travel which closes the reclosable fastener.
Figure 4:
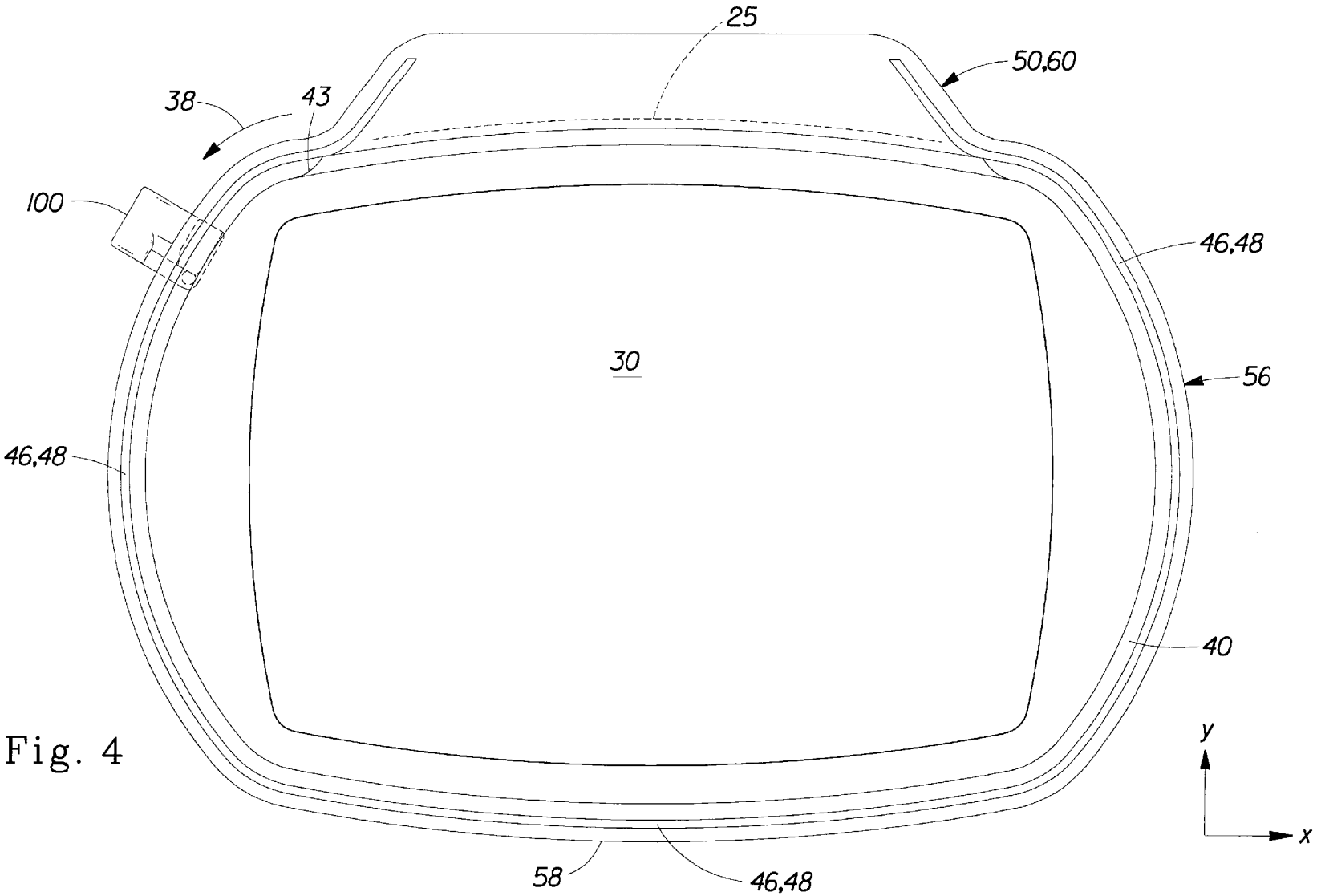
FIG. 4 is a top view of the storage container depicted in FIG. 1 showing the travel path of the slider and a second direction of travel which opens the reclosable fastener.

FIGS. 3 and 4 show top views of the storage container 10 depicted in FIG. 1. The track 46 is congruent with the reclosable fastener 40 along all edges of the lid 30 and flange 20 except for the edge occupied by the hinge line 25. The track 46 runs from one side of the hinge line 25 comprising an opened end 50 of the fastener to the other side of the hinge line 25 comprising a closed end 52.

In the configuration shown in FIGS. 3 and 4, the track 46 defines a travel path 48 comprising two opposing arcs 54, 56 curved concave towards the center of the container joined by a predominantly straight, although slightly curved sector 58 opposite the hinge line 25. As the track 46 approaches the open end 50 of the fastener near the hinge line 25, the track 46 diverts away from the fastener in order to direct the slider 100 to a parking place 60 enabling the lid 30 to rotate about the hinge line 25 or be removed from the container without interfering with the slider 100.

As illustrated in FIGS. 2*a* and 2*b*, the track 46 can comprise a slot 70 in the top side of the lid 30 congruent with the recessed element 44 of the reclosable fastener 40. The slot 70 includes an inside edge 72 nearest the recessed element 44 and an outside edge 74 opposite the inside edge 72. The slot 70 in the top side 32 of the lid 30 forms a bead 76 on the bottom side 34 of the lid 30 which interfaces with a complementary slot 80 in the top side 22 of the flange 20 congruent with the protruded element 42 of the reclosable fastener 40. The slot 80 in the top side 22 of the flange 20 protrudes through the flange 20 forming a bead 82 on the bottom side 24 of the flange 20. The bead 82 on the bottom side 24 of the flange 20 includes an inside edge 84 nearest to the opened end 41 of the protruded element 42 and an outside edge 86 opposite the inside edge 84.

The inside edge 84 of the bead 82 on the bottom side 24 of the flange 20 generally defines a first edge 90 of the track 46 for the slider embodiments described hereunder. In one slider embodiment, the outside edge 81 of the slot 80 in the top side 22 of the flange 20 forms the second edge 94 of the track 46 when such slider is disposed in the opening mode whereas the outside edge 74 of the slot 70 in the top side 32 of the lid 30 forms the second edge 92 of the track when such slider is disposed in the closing mode. In another embodiment, the outside edge 74 of the slot 70 in the top side 32 of the lid 30 defines second edge 92 of the track 46 when the slider is disposed in both the opening and the closing modes.

Figure 5A:
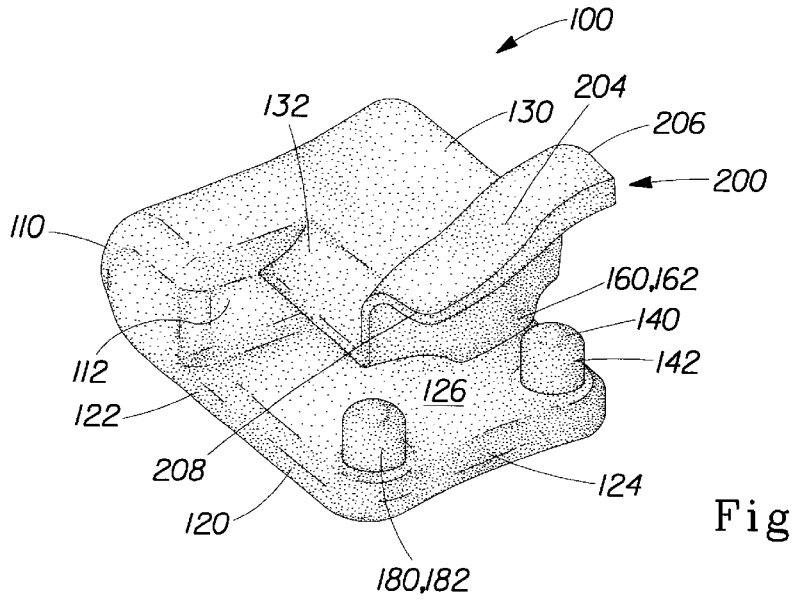
FIG. 5*a* is a perspective view of an embodiment of a slider according to the present invention.
Figure 5B:
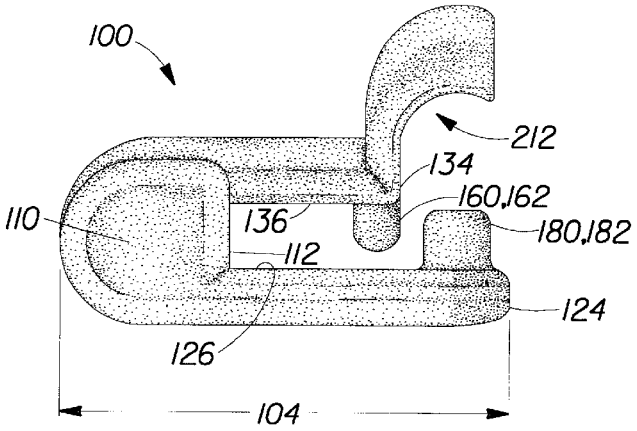
FIG. 5*b* is side view along the width of the slider depicted in FIG. 5*a* showing the closing end of the slider.
Figure 5C:
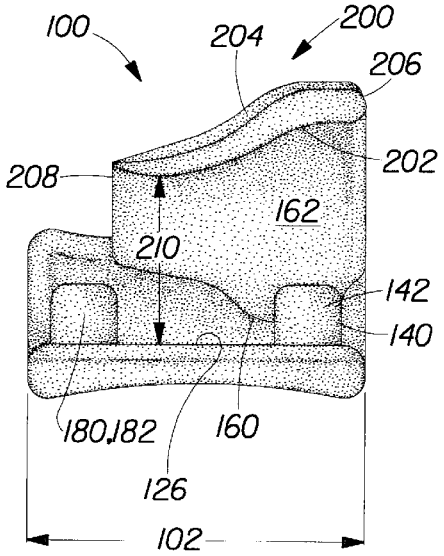
FIG. 5*c* is a side view along the length of the slider depicted in FIG. 5*a*

As illustrated in FIGS. 3 and 4, the slider 100 is slidably attachable to the track 46 and moveable along the travel path 48. The slider 100 has a length 102 running parallel to the travel path 48 and a width 104 running orthogonal thereto. As shown in FIG. 5*a*, 5*b*, and 5*c*, the C-shaped body of the slider 100 comprises a base 110 having a first surface 112 with first and second elongate members 120, 130 extending therefrom in a side-by side arrangement. The first and second elongate members 120, 130 each have proximal ends 122, 132 depending from the first surface 112 of the base 110, distal ends 124, 134 extended away from the first surface 112 and opposing internal surfaces 126, 136. The first elongate member 120 includes a pivot 140 depending from the internal surface 126 at the distal end 124 projecting towards the second elongate member 130. The second elongate member 130 includes a tracking member 160 depending from the internal surface 136 at the distal end 134 projecting towards the first elongate member 120.

The tracking member 160 may be aligned with the pivot 140 along the length 102 of the slider 100 and along the width 104 of the slider 100. Alternatively, the tracking member 160 may be offset from the pivot 140 along the length 102 of the slider and along the width 104 of the slider 100. Preferably, as shown in FIGS. 5*a*–5*c*, the tracking member 160 is offset from the pivot 140 along the width 104 of the slider 100 and aligned with the pivot 140 along the length 102 of the slider 100.

In configurations where the reclosable fastener defines the travel path 48, the first and second elongate members 120, 130 straddle the peripheral edges of the lid 30 and flange 20 while the pivot 140 and tracking member 160 interface with the interlocking elements of the fastener 42, 44. Particularly, the pivot 140 may interface with the opened end 41 of the protruded element 42 on the bottom side 24 of the flange 20 and the tracking member 160 may interface with the non-interlocking surface 47 of the recessed element 44 on the top side 32 of the lid 30.

In the assembled configurations illustrated in FIGS. 6*a* and 6*b*, the first and second elongate members 120, 130 straddle the peripheral edges of the lid 30 and flange 20 as the pivot 140 and tracking member 160 interface with the slot 70 on the top side of the lid 30 and the bead on the bottom side 24 of the flange 20. Particularly, in the closing mode shown in FIGS. 6*a*, the tracking member 160 is disposed against the outside edge 74 of the slot 70 in the top side of the lid 30 while the pivot 140 butts against the inside edge 84 of the bead 82 on the bottom side 24 of the flange 20. In the opening mode illustrated in FIG. 6*b*, the tracking member 160 is disposed against the outside edge 81 of the slot 80 in the top side 22 of the flange 20 while the pivot 140 rests against the inside edge 84 of the bead 82 on the bottom side 24 of the flange 20.

The pivot 140 enables the slider 100 to rotate about the distal end 124 of the first elongate member 120, particularly along curvilinear sectors and transition regions having vector components extending in the X and Y directions. For this reason, the pivot 140 comprises an oval, preferably cylindrical external surface 142 which interfaces with the track 46. In order for the slider 100 to properly rotate about the pivot 140 along curvilinear sectors or transition regions along the travel path 48, the pivot 140 is assembled on the concave side of the curvilinear sectors or transition regions while the tracking member 160 is assembled along the convex side. This enables the base 110 of the slider 100 to rotate relative to distal ends of the elongate members as the slider 100 moves along the curvilinear sectors of the travel path 48.

The tracking member 160 generally maintains the attachment of the slider 100 to the track 46 and guides the slider 100 along the travel path 48. However, the tracking member 160 may also serve as a pivot particularly where the travel path 48 takes on a wavy pattern such as a sinusoidal shape requiring both the base 110 and the distal ends of the elongate members to rotate relative to one another depending upon the slider 100 location along the travel path 48. The external surface 162 of the tracking member 160 is preferably convex in shape in order to minimize frictional contact with the track 46. However, the external surface 162 is oval and preferably, cylindrical if the tracking member 160 is also required to function as a pivot.

Although rotation of the slider 100 is desirable, particularly in transition regions along the travel path 48, it may be necessary to maintain proper orientation of the slider 100 relative to the reclosable fastener 40 to ensure that portions of slider 100 interfacing with the interlocking elements 42, 44, described hereunder, are properly oriented relative to the fastener. This may be enable the slider 100 to operate more effectively in opening and closing the fastener. For instance, proper orientation of the slider 100 may include the length 102 of the slider 100 being substantially parallel to the travel path 48 while the width 104 is substantially orthogonal thereto. Such an orientation can be maintained by a rotation restraint 180 disposed on the slider 100 that interfaces with the reclosable fastener 40 or the track 46.

Although the rotation restraint 180 may comprise a number of different configurations to control the rotation of the slider 100, the rotation restraint 180 for the slider illustrated in FIGS. 5*a*–5*c* comprises a pin 182 disposed on the internal surface 126, at the distal end 124 of the first elongate member 120 projecting towards the second elongate member 130. As shown, the pin 182 is spaced apart from the pivot 140 along the length 102 of the slider 100 and in alignment with the pivot 140 along the width 104 of the slider 100. Like the pivot 140, the pin 182 interfaces with the travel path 48 by resting against the inside edge 84 of the bead 82 on the bottom side 24 of the flange 20.

The distance between the restraint and the pivot 140 is limited, depending upon the travel path 48, particularly on the radius of curvature of the transition regions along the travel path 48. The greater the radius of curvature the greater the allowable distance separating the pivot 140 and the rotation restraint 180. Likewise, the smaller the radius of curvature the smaller the allowable distance therebetween.

Like the pivot 140 and the tracking member 160, the external surface of the pin 182 is shaped to minimize frictional contact with the track 46. The external surface can have a convex shape in order to limit the interface to point contact.

As previously described, the primary function of the slider 100 is to bias the interlocking elements 42, 44 of the reclosable fastener 40 together as the slider 100 moves in a first direction 36 closing the fastener and to apply separating forces to the interlocking elements 42, 44 as the slider 100 moves in a second direction 38 opposite the first direction 36 opening the fastener. The slider generally includes features that provide these functional characteristics.

In the embodiment shown in FIGS. 5*a*–*c*, the slider 100 includes a wedge 200 disposed on the distal end 124 of the second elongate member 130, adjacent to, but opposite the tracking member 160. The wedge 200 is disposed away from the first surface 112 of the base 110 to interface with the interlocking elements 42, 44 of the reclosable fastener 40. The wedge 200 comprises an internal surface 202 and an external surface 204, an opening end 206 and a closing end 208. Spacing 210 between the internal surface 202 of the wedge 200 and the first elongate member 120 forms a channel 212 which converges along the length 102 of the slider 100 from a maximal distance at the opening end 206 of the wedge 200 to a minimal distance at the closing end 208 of the wedge 200.

As shown, the wedge 200 can be frustoconical having a concave internal surface 202 and a convex external surface 204. In order to minimize frictional contact with the interfacing components of the fastener 40, both the internal surface and the external surface of the wedge may comprise wavy contours extending from the opening end 206 to the closing end 208. For instance, the contour of the external surface 204 may be convex relative to the travel path 48 near the opening end 206 and concave relative to the travel path 48 near the closing end 208 while the contour of the internal surface 202 may be concave near the opening and 206 and convex near the closing end 208.

For the slider embodiment illustrated in FIGS. 5*a*–*c*, the wedge 200 provides the function of opening and closing the reclosable fastener 40. In the closing configuration illustrated in FIG. 6*a*, the concave internal surface 202 of the wedge 200 partially encloses the bulbous non-interlocking surface 47 of the recessed element formed in the lid 30 while internal surface of the first elongate member 120 contacts the bottom side 24 of the flange 20 at the bead 82 protruding therethrough forming the track 46. As the slider 100 moves along the travel path 48 in the first direction 36 shown in FIG. 3, the converging channel formed between the concave internal surface 202 of the wedge 200 and the internal surface 126 of the first elongate member 120 biases the interlocking elements 42, 44 together in a sealing arrangement.

Once the slider 100 travels the length of the travel path 48 in the first direction 36 closing the fastener, the slider 100 can be placed in the opening configuration by reversing direction and interposing the wedge 200 between the interlocking elements 42, 44. A flexible lip 43 extending from the recessed element 44 of the fastener 40 on the top side of the lid 30, at the closed end 52 of the travel path 48 may be provided to enable the wedge 200 to initiate separation of the two elements 40,42.

In the opening configuration illustrated in FIG. 6*b*, the wedge 200 is disposed between the interlocking elements 42, 44 so that the concave internal surface 202 of the wedge 200 partially encloses the interlocking surface 45 of the protruding element while the groove 49 of the recessed element encloses the frustoconical external surface 204 of the wedge 200. As the slider 100 moves in the second direction 38 illustrated in FIG. 4, the frustoconical external surface 204 of the wedge 200 urges the interlocking elements 42, 44 apart to open the reclosable fastener 40.

In the embodiment previously described, the wedge 200 performs both the opening and closing operation forcing the user to either fully open or fully close the fastener 40 before changing to the opposing operation. By providing a slider having separate components designated for opening and closing the fastener, the user can switch from the opening mode to the closing mode at any point along the travel path.

Figure 7A:
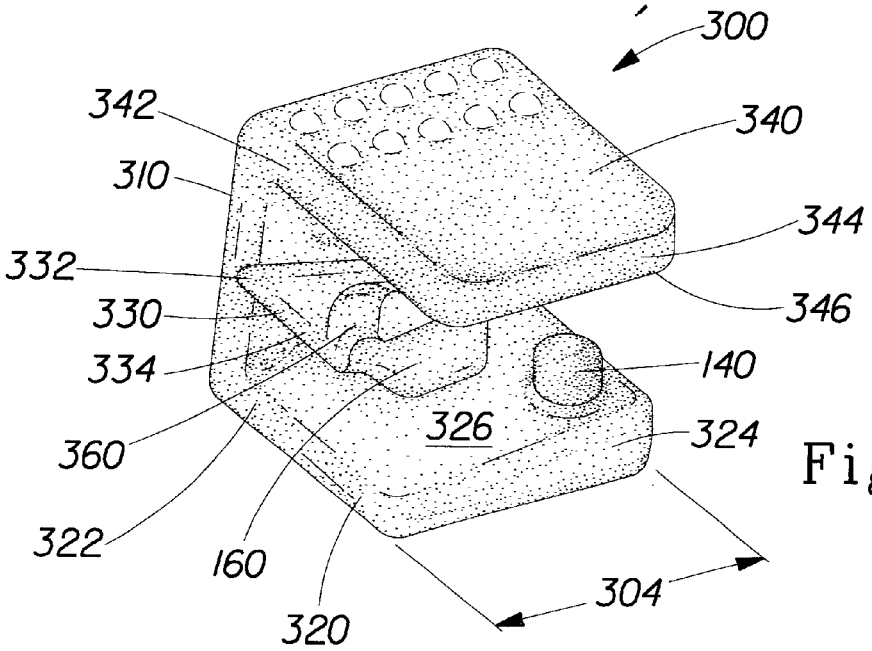
FIG. 7*a* is a perspective view of an alternate embodiment of a slider according to the present invention.
Figure 7B:
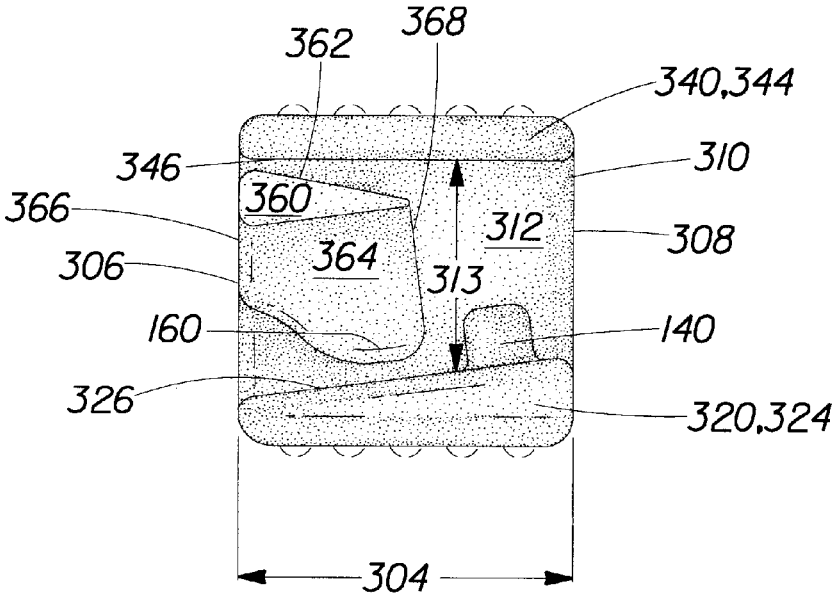
FIG. 7*b* is side view along the length of the slider depicted in FIG. 7*a*.

In an alternate embodiment shown in FIGS. 7*a* and 7*b*, the slider 300 comprises a third elongate member 340 having a proximal end 342 depending from the first surface 312 of the base 310, a distal end 344, and an internal surface 346. The third elongate member 340 is spaced apart from the first and second elongate members 320, 330 with the second elongate member 330 being interposed between the first and third elongate members 320, 340.

The first and third elongate members 320, 340 cooperate to perform the closing operation of the slider 300. The internal surface 346 of the third elongate member 340 interfaces with the non-interlocking bulbous surface 47 of the recessed element 44 while the internal surface 326 of the first elongate member 320 interfaces with the bead 82 forming the track on the bottom side 24 of the flange 20. The internal surface 326 of the first elongate 320 is tapered so that the spacing 313 between the internal surface 326 of the first elongate member 320 and the internal surface 346 of the third elongate member 340 varies along the length 302 of the slider from a maximal distance at the opening end 306 to a minimal proximal distance at the closing end 308 forming a converging channel therebetween. The measure of the minimal proximal distance is designed to bias the interlocking elements 42, 44 of the reclosable fastener 40 into engagement with one another.

Figure 8A:
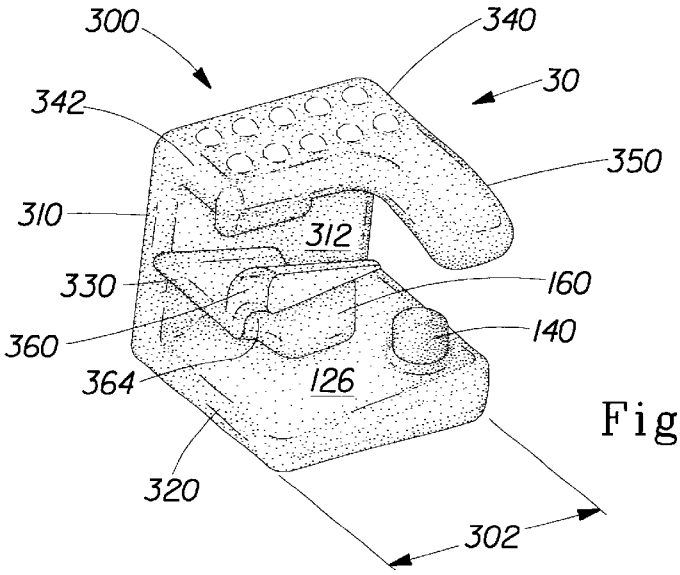
FIG. 8*a* is a perspective view of a modified configuration of the slider embodiment illustrated in FIGS. 7*a*–7*b*.
Figure 8B:
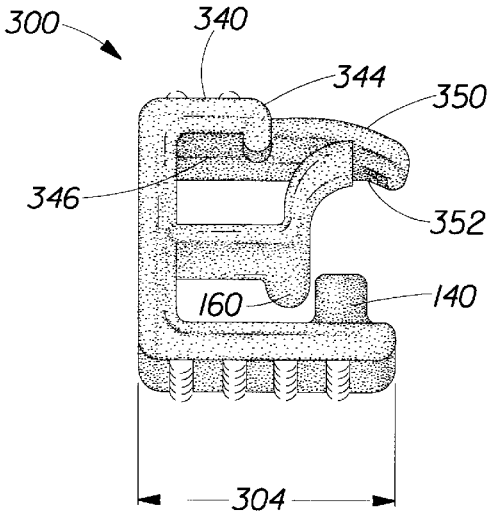
FIG. 8*b* is a side view along the width of the slider depicted in FIG. 8*a* showing the opening end of the slider.
Figure 8C:
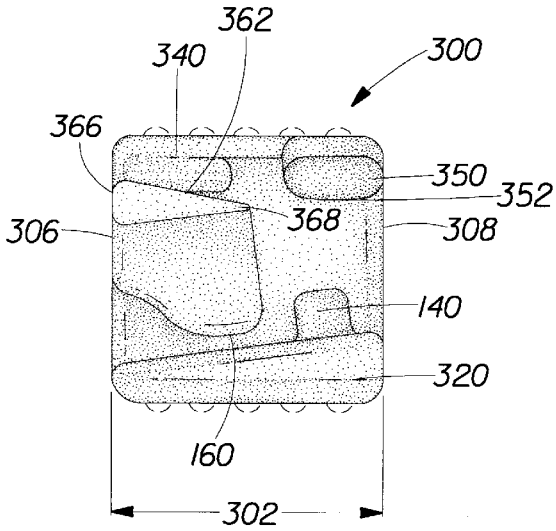
FIG. 8*c* is side view along the length of the slider depicted in FIG. 8*a*.

In order to minimize frictional contact between the slider 300 and the reclosable fastener 40, The third elongate member 340 may be modified as shown in FIGS. 8*a*–8*c*. The third elongate member 340 may be shorter than the first elongate member 320 and comprise a finger member 350 disposed at the distal end 344 of the third elongate member 340. The finger member 350 is positioned adjacent to the closing end 308 of the slider 300, projecting parallel to the width 304 thereof.

Figure 9A:
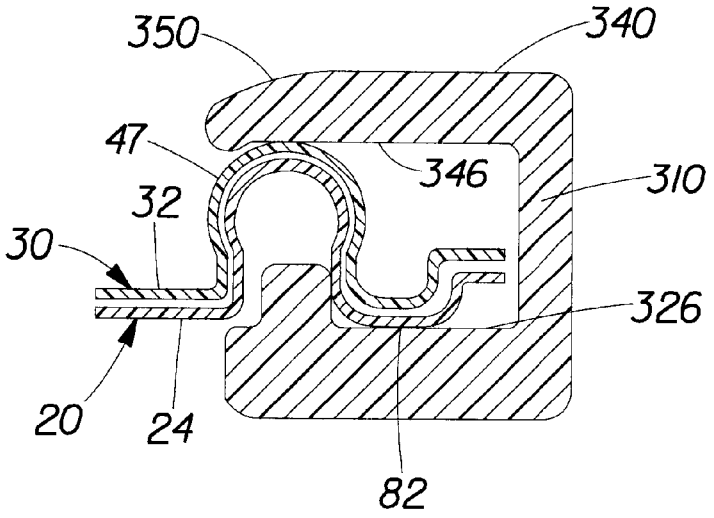
FIG. 9*a* is a cross sectional view of the closing end of the slider depicted in FIGS. 8*a*–8*c* shown slidably attached to a reclosable fastener in the closing configuration.

As further illustrated in FIG. 9*a*, the finger member 350 comprises an internal surface 352 which interfaces with the top side 32 of the lid 30, particularly, the non-interlocking bulbous surface 47 of the recessed element 44. At the same time, the internal surface 326 of the first elongate member 320 interfaces with the bottom side 24 of the flange 20, particularly, the bead 82 forming the track 46 along side of the opened end 41 of the protruded element 42 of the reclosable fastener 40.

Since the closing operation occurs primarily at the closing end 308 of the slider, the shorter third elongate member 340 can minimize contact with the fastener while the finger member 350 cooperates with the first elongate member 320 to bias the interlocking elements 42, 44 of the fastener 40 into engagement with one another. In order to provide better conformity with the non-interlocking bulbous surface 47 of the recessed element 44, the internal surface 352 of the finger member 350 may be curved concave towards the first elongate member 320.

To perform the opening operation for the embodiments illustrated in FIGS. 7*a*–7*b* and 8*a*–8*c*, a wedge 360 is interposed between the first and third elongate members 320, 340. As shown, the wedge 360 may be disposed at the distal end 334 of the second elongate member 330. The wedge 360 is tapered such that the external surface 362 of the wedge 360, opposite the internal surface 346 of the third elongate member 340, is sloped towards the first elongate member 320 from a first end 366 adjacent the opening end 306 of the slider 300 to a second end 368 approaching the closing end 308 of the slider 300. The cross section of the wedge 360 decreases from the first end 366 to the second end 368.

Figure 9B:
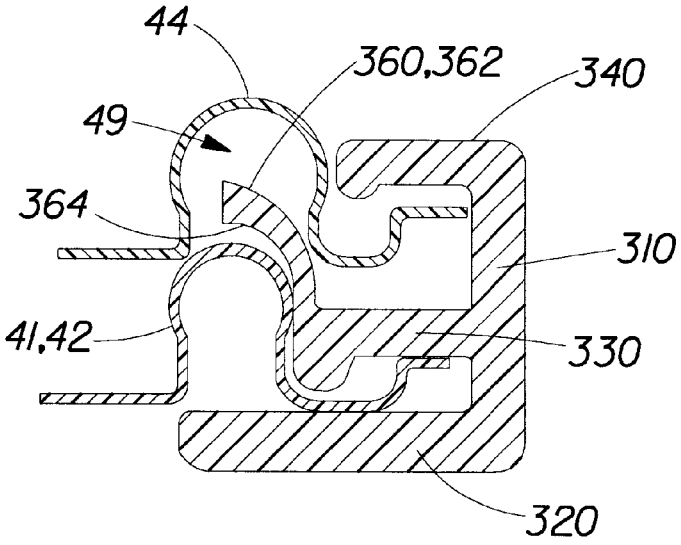
FIG. 9*b* is a cross sectional view of the opening end of the slider depicted in FIG. 8*a*–8*c* shown slidably attached to a reclosable fastener in the opening configuration.

In its assembled configuration illustrated in FIG. 9*b*, the wedge 360 is interposed between the interlocking elements 42, 44 of the reclosable fastener 40 with the internal surface 364 of the wedge 360 partially enclosing the bulbous interlocking surface 41 of the protruded element 42 while the external surface 362 of the wedge 360 interfaces with the groove 49 of the recessed element 44. In order to provide better conformity with the two interlocking elements 42, 44 the internal surface 364 may be concave towards the first elongate member 320 while the external surface 362 may be frustoconical.

So that the wedge 360 performing the opening function does not interfere with the aforementioned features performing the closing operation and vice versa, the second end 368 of the wedge 360 is spaced apart from the closing end 308 of the slider. Preferably, the second end of the wedge is spaced a predetermined distance from a plane disposed at the closing end 308 of the slider 300 defined by the minimal proximal distance between the internal surface 326 of the first elongate member 320 and the internal surface 346 of the third elongate member or internal surface 352 of the finger member 350, depending on the embodiment.

The sliders according to the present invention are preferably injection molded from high density polyethylene. However, one skilled in the art would recognize that such sliders may be manufactured from any moldable or machinable material utilizing machining or molding operations known in the art.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A slider for opening or closing a rigid, elongate reclosable fastener lying in a two dimensional plane defining orthogonal X and Y directions, comprising:

a base having a first surface;

a first elongate member having an internal surface, a proximal end depending from the first surface of the base and a distal end;

a second elongate member spaced apart from the first elongate member, the second elongate member having an internal surface, a proximal end depending from the first surface of the base and a distal end;

a pivot depending from the internal surface of the first elongate member at the distal end thereof and projecting towards the second elongate member; and a tracking member depending from the internal surface of the second elongate member at the distal end thereof and projecting toward the first member, the slider further comprising a width running parallel to the first and second elongate members and a length running orthogonal to the first and second elongate members, wherein the pivot is spaced apart from the tracking member along the width.

2. The slider according to claim 1, wherein the pivot interfaces with a first edge of the track and the tracking member interfaces with a second edge of the track opposed to the first edge whereby the slider is transportable along the track in a travel path having at least one arc wherein the first edge of the at least one arc has a smaller radius of curvature than the second edge.

3. The slider according to claim 2 wherein the pivot is aligned with the tracking member along the length of the slider.

4. The slider according to claim 2, wherein the tracking member comprises a second pivot.

5. The slider according to claim 2 further comprising a rotation restraint for maintaining the first and second elongate members normal relative to the track.

6. The slider of claim 5 wherein the rotation restraint comprises a pin interfacing with the track wherein the pin depends from the internal surface of the first elongate member and projects toward the second elongate member.

7. The slider of claim 6, wherein the pin is aligned with the pivot along the width of the slider and offset a distance from the pivot along the length of the slider.

8. The slider according to claim 5 further comprising a third elongate member depending from the base and spaced apart from the first and second elongate members such that the second elongate member is disposed between the first and third elongate members, wherein the rotation restraint is disposed on the third elongate member.

9. A method of opening or closing a reclosable fastener lying in a two dimensional plane defining orthogonal X and Y directions comprising the steps of:

providing a track along the reclosable fastener defining a travel path having vector components extending in each of the X and Y directions; the track has a finite width defined by first and second opposing edges and at least one arc wherein the first edge has a lesser radius of curvature at the at least one arc relative to the radius of curvature of the second edge at the at least one arc;

providing a slider slidably attached to the track, the slider comprising first and second elongate members extending from a base, a pivot disposed perpendicular to the first elongate member and projecting toward the second elongate member; and a tracking member disposed perpendicular to the second elongate member and projecting towards the first elongate member, wherein the pivot interfaces with the first edge of the track and the tracking member interfaces with the second edge of the track; and sliding the reclosable fastener along the track in a first direction to open the reclosable fastener and in a second direction, opposite the first direction, to close the reclosable fastener.

10. The method of claim 9 wherein the tracking member comprises a second pivot and the track comprises a second arc wherein the second edge has a small radius of curvature at the second arc relative to the radius of curvature of the first edge.

11. A container closable with a cover, the container having a perimeter at least partially sealable therearound by a seal disposed between the cover and the container, the seal comprising a reclosable fastener lying in a two dimensional plane defining orthogonal X and Y directions, the reclosable fastener having a track congruent therewith providing a travel path having vector components extending in each of the X and Y directions, wherein the track has a finite width defined by first and second opposing edges and at least two arcs wherein the first edge has a lesser radius of curvature relative to the second edge at the at least two arcs, the reclosable fastener is sealable or unsealable with a slider, the slider is slidably attached to the track and moveable along the travel path, wherein the slider is pivotable about the first edge of the track, and wherein the slider opens the reclosable fastener by sliding along the travel path in a first direction and closes the reclosable fastener by sliding along the travel path in a second direction opposite the first direction.

12. A slider for opening or closing an elongate reclosable fastener lying in a two dimensional plane defining X and Y directions and having interlocking protruded and recessed elements and tracks extending along the length thereof defining a travel path having vector components extending in each of the X and Y directions;

the slider comprising a wedge having an internal surface and an external surface, a closing end and an opening end, both the internal surface and the external surface are inclined in the first direction from the closing end to the opening end, wherein the internal surface presses the recessed element into engagement with the protruded element as the slider moves in the first direction during closing and the external surface separates the recessed element from the protruded element as the slider moves in the second direction during opening.

13. The slider according to claim 12 wherein the wedge has a frustoconical shape with an open internal surface.

14. The slider according to claim 13 wherein the external surface of the wedge comprises a wavy contour extending from the closing end to the opening end which is concave at the closing end and convex at the opening end.

15. The slider according to claim 14 wherein the open internal surface of the wedge comprises a wavy contour extending from the closing end to the opening end which is convex at the closing end and concave at the opening end.

16. The slider according to claim 14 wherein the open internal surface of the wedge partially encloses the recessed element during closing.

17. The slider according to claim 14 wherein the open internal surface of the wedge partially encloses the protruded element during opening.

18. The slider according to claim 13, further comprising:

a base having a first surface;

a first elongate member having a proximal end depending from the first surface and a distal end;

a second elongate member spaced apart from the first elongate member, the second elongate member having a proximal end depending from the base and a distal end;

wherein the wedge is disposed at the distal end of the second elongate member.

19. The slider according to claim 18, further comprising a finger member disposed at the distal end of the third elongate member at the closing end thereof projecting parallel to the width of the slider.

20. The slider according to claim 19 wherein the finger member comprises a concave internal surface and a convex external surface.

21. The slider according to claim 20 wherein the concave internal surface of the finger member partially encloses a non-interlocking surface of the recessed element of the reclosable fastener.

22. The slider according to claim 21 wherein the internal surface of the wedge partially encloses the interlocking surface of the protruded element of the reclosable fastener while the external surface of the wedge interfaces with the groove of the recessed element.

* * * * *

UNITED STATES PATENT AND TRADEMARK OFFICE
Certificate

Patent No. 6,394,299 B1 Patented: May 28, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael Sean Farrell, Terrace Park, OH (US); and Matthew Todd Hupp, Sharonville, OH (US).

Signed and Sealed this Sixth Day of November 2007.

NATHAN J. NEWHOUSE
*Supervisory Patent Examiner*
Art Unit 3727